United States Patent [19]

Dean et al.

[11] 4,450,660

[45] May 29, 1984

[54] THERMAL BARRIER

[76] Inventors: E. Keith Dean, 1510 Washington Blvd.; Phillips C. Emmons, 1314-12th St., both of Huntington, W. Va. 25701

[21] Appl. No.: 426,937

[22] Filed: Sep. 29, 1982

[51] Int. Cl.[3] ..... E06B 3/26; E06B 7/12; E04B 2/00; B21D 39/00

[52] U.S. Cl. ..... 52/202; 52/407; 52/172; 52/475; 29/455 R

[58] Field of Search ..... 52/202, 203, 303, 304, 52/404, 407, 173, 172, 171, 397, 406, 408, 475, 488, 490, 208, 573, 788, 789, 790, 791; 49/475; 428/34; 29/455 R, 455 LM, 463

[56] References Cited

U.S. PATENT DOCUMENTS

| | | | |
|---|---|---|---|
| 2,391,436 | 12/1945 | Miskella | 29/455 |
| 2,507,578 | 5/1950 | Schileroort | 29/463 |
| 2,579,157 | 12/1951 | Price, Sr. et al. | 52/809 |
| 2,582,458 | 1/1952 | Rose | 52/790 |
| 2,756,467 | 7/1956 | Etling | 52/304 |
| 2,777,548 | 1/1957 | Adams | 52/475 |
| 2,877,876 | 3/1959 | Musselman | 52/408 |
| 2,935,769 | 5/1960 | Lutes | 52/208 |
| 3,028,638 | 4/1962 | Goellner | 52/203 |
| 3,110,370 | 11/1963 | Wulf, Sr. et al. | 29/455 |
| 3,141,206 | 7/1964 | Stephens | 52/406 |
| 3,364,639 | 1/1968 | Davenport | 52/407 |
| 3,911,630 | 10/1975 | Nally | 52/202 |
| 3,998,015 | 12/1976 | Scott et al. | 52/222 |
| 4,040,210 | 7/1977 | Land | 52/171 |
| 4,069,630 | 1/1978 | Chess et al. | 52/172 |
| 4,098,035 | 7/1978 | Bessler | 52/202 |
| 4,126,966 | 11/1978 | Lobell | 49/475 |
| 4,133,367 | 1/1979 | Abell | 52/202 |
| 4,160,348 | 7/1979 | Chapman et al. | 52/202 |
| 4,204,015 | 5/1980 | Wardlaw et al. | 428/34 |
| 4,255,907 | 3/1981 | Lightell | 52/202 |

FOREIGN PATENT DOCUMENTS

| | | | |
|---|---|---|---|
| 52-42001 | 4/1977 | Japan | 29/463 |
| 411292 | 11/1966 | Switzerland | 52/580 |

*Primary Examiner*—John E. Murtagh
*Assistant Examiner*—Andrew Joseph Rudy
*Attorney, Agent, or Firm*—Sherman Levy

[57] ABSTRACT

A thermal barrier is provided that includes a pair of sheets made of a material such as suitable plastic, and wherein the pair of sheets interfit to form a hollow panel. Compressible cellular foam material is mounted on the outer edges of the panel. Ambient air is adapted to be removed from the interior of the panel, and dry air or inert gas is adapted to be introduced into the hollow panel. Angle clips are provided for helping to maintain the barrier in its proper assembled position.

10 Claims, 8 Drawing Figures

THERMAL BARRIER

FIELD OF THE INVENTION

The present invention relates to a thermal barrier, and more particularly to a low cost dual plastic pane sealed air unit which does not require a separate frame. Further, the barrier is designed for installation on the inside of an existing window opening and mounts within the existing jamb head and sill on the inside of the existing window which remains in place. With the present invention, overall heat transmission, air infiltration by crack leakage, and solar heat gain reflects a reduction of 65 to 70 percent and therefore saves 65 to 70 percent of the energy consumed through the opening. Also, the estimated cost of the barrier is such that a pay-back period from energy saved can be realized in about two years in certain locations.

DESCRIPTION OF THE PRIOR ART

Heretofore, various types of thermal barriers or storm windows have been provided, and for example attention is directed to prior U.S. Pat. Nos.: 4,098,035; 4,040,210; 3,911,630; 4,069,630; and 4,204,015. However, neither these prior patents or any other known to applicant achieves the advantages that the present invention achieves or accomplishes.

BACKGROUND AND SUMMARY OF THE INVENTION

In accordance with the present invention, there is provided a thermal barrier wherein custom window sizes can be constructed with the design and wherein the preferred mode is to manufacture the units for existing stock size window openings and to accomplish the exact fit by the addition of foam tape as required.

The thermal barrier is constructed so that condensation is minimized or provided since the barrier is installed on the inside where the temperature of the barrier will be above the dew point. Further the barrier is installed on the inside and the barrier is adapted to be made from materials that are readily available from suppliers, and the materials that are used have a long life expectancy.

An object of the present invention is to provide a thermal barrier which is a low cost, dual plastic pane sealed air unit that does not require a separate frame. The barrier is designed for installation on the inside of an existing window opening and mounts within the existing jamb, head, and sill on the inside of the existing window which remains in place.

Another object of the present invention is to provide a thermal barrier wherein the overall heat transmission, air infiltration by crack leakage, and solar heat gain reflects a reduction of 65 to 70 percent and consequently saves 65 to 70 percent of the energy consumed through the opening.

Still, a further object of the present invention is to provide a thermal barrier which is comparatively simple in its construction and mode of use, and which is ruggedly constructed and relatively inexpensive to manufacture and efficient to use.

Other objects, features, and advantages of the invention shall become apparent as the description thereof proceeds in connection with the accompanying illustrative drawings.

DESCRIPTION OF THE PREFERRED EMBODIMENT

Figure 3:
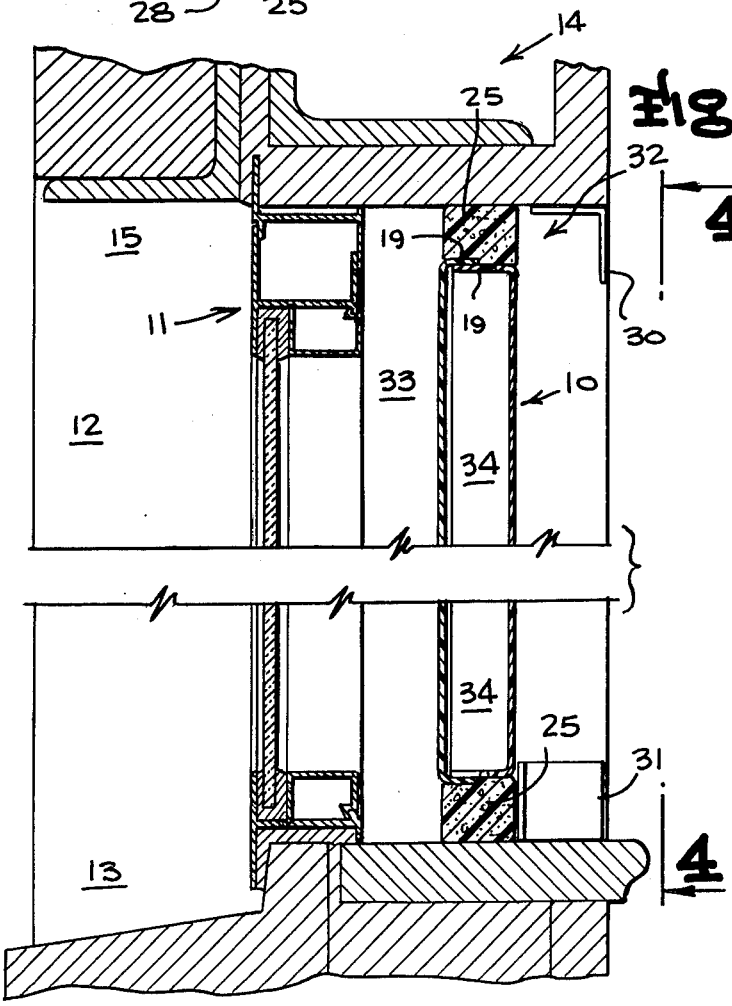
FIG. 3 is an enlarged sectional view taken on the line 3—3 of FIG. 1.
Figure 4:
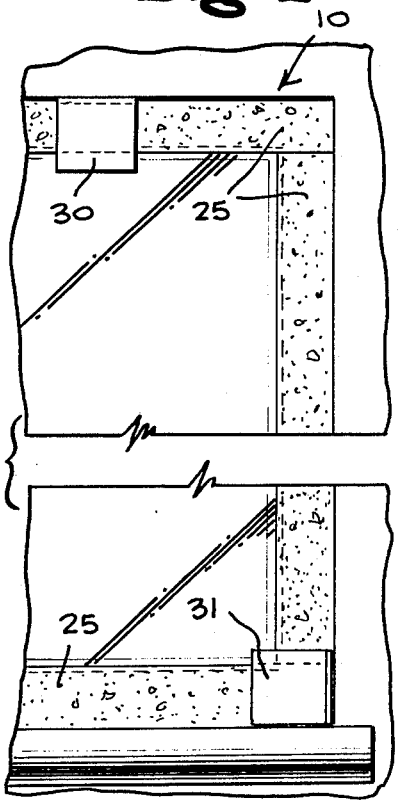
FIG. 4 is a fragmentary, elevational view generally taken along the lines 4—4 of FIG. 3.

Referring in detail to the drawings, the numeral 10 indicates the thermal barrier of the present invention which is adapted to be used with a window 11, FIG. 3, and there is provided the usual head 12 with a similar jamb, and numeral 13 indicates the window sill. The numeral 14 in FIG. 3 indicates the existing wall, and there is provided the clear opening 15.

Figure 2A:
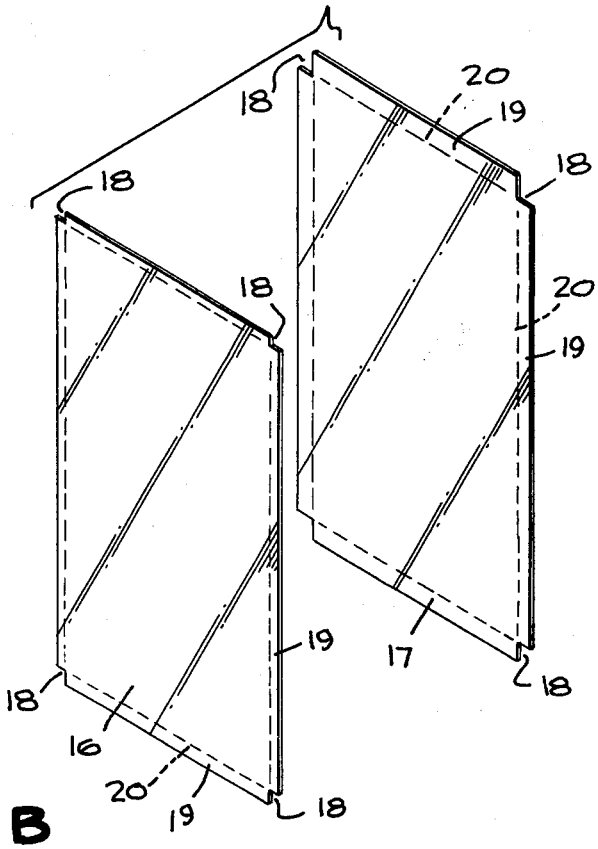
FIGS. 2A, 2B, 2C, and 2D are exploded perspective views showing the steps of fabricating the thermal barrier of the present invention.
Figure 2B:
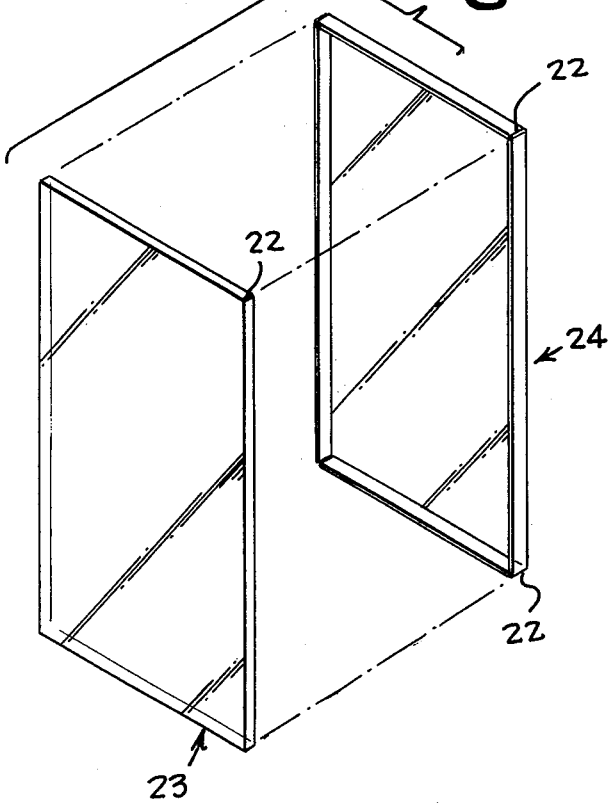

As shown in FIG. 2A there is provided a pair of similar rectangular plastic sheets 16 and 17, and each of the sheets 16 and 17 have all four corners cut away as at 18 to provide notches. The upper and lower and side edge portions 19 of the sheets 16 and 17 are adapted to be bent and folded to form a pair of flat pan-shaped members 23 and 24, FIG. 2B. The pair of pan-shaped members 23 and 24 are adapted to be assembled together to provide a panel or hollow box-like member 21, FIG. 2C. Cement 22 is adapted to be used where desired or required such as in the corners of the pan-shaped members 23 and 24, FIG. 2B.

Figure 2C:
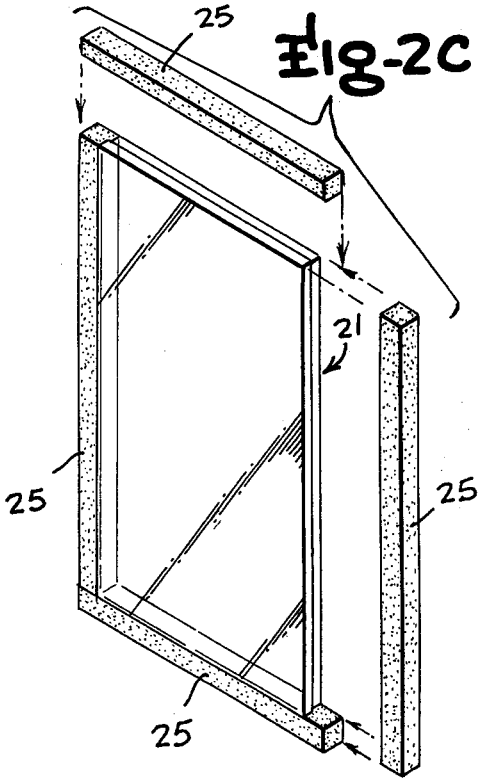

As shown in FIG. 2C, cellular foam strips 25 are secured to the outer edge portions of the hollow panel 21.

Figure 2D:
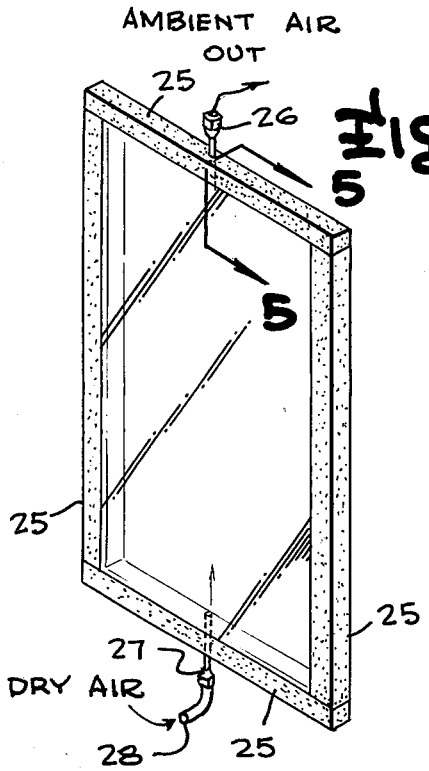

Referring to FIG. 2D of the drawings, there is illustrated a method of removing ambient air from the hollow interior of the panel 21 as well as introducing dry air or inert gas into the interior of the panel. Thus, the fittings 26 and 27 are provided, and these fittings may include suitable needle like members 29, FIG. 5. The fitting 26 can be used for removing ambient air from the interior of the panel, and the other fitting 27 can be used for introducing dry air or inert gas into the interior of the panel. A suitable hose, conduit, or the like 28 can be used for supplying dry air or inert gas from a suitable source of supply to the interior of the panel.

Figure 1:
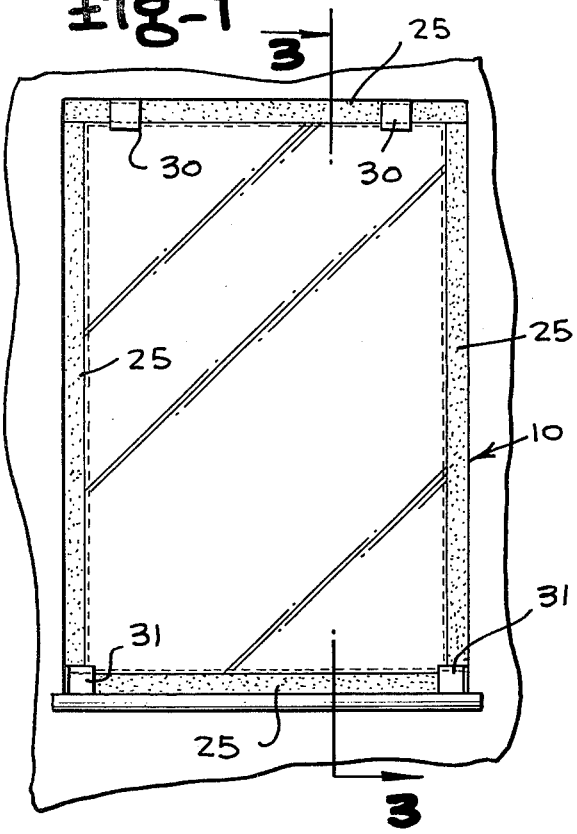
FIG. 1 is an elevational view of a window with the thermal barrier of the present invention installed.

Referring to FIG. 1 of the drawings, there is illustrated angle clips 30 and 31 which are adapted to be used with the thermal barrier. The upper clips 30 are spaced inwardly from the surface of the barrier 10, and in addition there is provided a slight amount of space 32, FIG. 3, between the upper clips 30 and the barrier 10 for a purpose to be later described. The lower clips 31 are adapted to abut the lower corner of the barrier. In FIG. 3 the numeral 33 indicates a space between the barrier 10 and the existing window 11.

Figure 5:
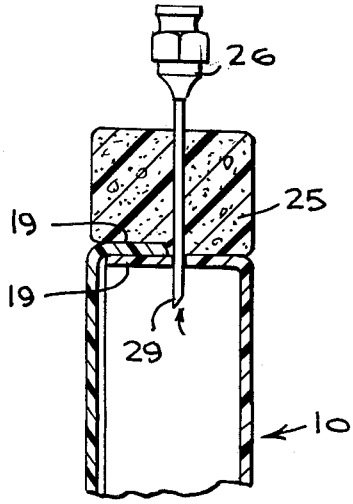
FIG. 5 is an enlarged sectional view taken on the line 5—5 of FIG. 2D.

From the foregoing it will be seen that there has been provided a thermal barrier, and in use with the parts arranged as shown in the drawings, the barrier 10 of the present invention is adapted to be made by utilizing the parts previously shown and illustrated. Thus, initially a pair of plastic sheets 16 and 17 are provided, and then corner portions of the sheets 16 and 17 are cut away or notched as at 18. Then, edge portions 19 of the sheets 16 and 17 are folded to a right angle position about the fold or crease lines 20 to provide the pair of members 23 and 24 shown in FIG. 2B. FIG. 2A shows the pair of sheets 16 and 17 with the notched or cut away corners 18. A suitable cement 22 is provided at the corners where desired or required. Next, as shown in FIG. 2C, with the pair of members 23 and 24 assembled together to form the hollow panel 21, the cellular foam strips 25 are arranged adjacent to the sides and upper and lower edges of the panel 21, and these cellular foam strips 25 are secured in place to the outer edges of the panel 21 in any suitable manner. Then, as shown in FIG. 2D, ambient air is adapted to be withdrawn from the interior of the hollow panel 21 by a suitable fitting 26, and at the same time dry air or inert gas can be introduced into the interior of the panel as shown in FIG. 2D. FIG. 5 illustrates in detail a needle-like member 29 that can be used as part of the fitting 26 or 27. With the unit or thermal barrier 10 completed and assembled, the thermal barrier 10 can be installed as shown in FIG. 3 so that there will be a space 33 between the thermal barrier 10 and the existing window 11. Angle brackets 31 are positioed adjacent to the lower corner portions of the thermal barrier 10, and the lower angle brackets 31 abut the thermal barrier. Upper angle brackets 30 are conveniently arranged at a suitable location, such as inwardly from the side portions of the thermal barrier. Upper angle brackets 30 are conveniently arranged at a suitable location, such as inwardly from the side portions of the thermal barrier, and there is provided a slight space 32 between the upper angle bracket 30 and the adjacent portion of the thermal barrier 10.

The parts can be made of any suitable material in different shapes and sizes as desired or required.

It will, therefore, be seen that there has been provided a thermal barrier which is a low cost, dual plastic pane sealed air unit that does not require a separate frame. The barrier is designed for installation on the inside of an existing window opening and mounts within the existing jamb, head, and sill on the inside of the existing window which remains in place. In FIG. 3, numeral 11 indicates the existing window. The overall heat transmission, air infiltration by crack leakage and solar heat gain reflects a reduction of 65 to 70 percent and consequently saves 65 to 70 percent of the energy consumed through the opening.

When fabricating the barrier, the following is given as a description of the materials that can be used together with the steps for installing the same:

1. One rectangular sheet 1/32"± thickness of appropriate size of polyethelene/acrylic plastic such as sheet 16 can be utilized.
2. One rectangular sheet 17 of 1/32"± thickness of appropriate size polyethelene/acrylic plastic is adapted to be utilized.
3. On sheet 17, scribe and cut approximately a 1" square corner as at 18 at all four corners.
4. On sheet 16, scribe and cut approximately a ½" square corner as at 18 at all four corners.
5. Sheet 16 shall be approximately 1/16" larger in length and width than sheet 17. Heat of approximately 280° F. to form a flat pan shape of approximately 1" in depth as indicated by the numerals 23 and 24 in FIG. 2B.
6. The corners of the pan 23 and 24 are filled with silicone or other compatible cement as at 22 to fill any voids and seal the corners.
7. One pan is sliped over the other pan which creates a box shape as at 21, FIG. 2C, with a 1" depth or thickness. The pans 23 and 24 are spot cemented to each other to form a rigid box unit 21.
8. The exposed ½" edges of sheets 16 and 17 are cemented to rectangular strip 25 of the closed cell foam material with stripping tape or contact cement, and the size of the foam is approximately 1" in width by ¾" in height.
9. The unit is then sealed and contains ambient air.
10. The ambient air is exhausted, as shown in FIG. 2D by inserting through the foam 25 and plastic, two needles, such as the needles 29, one for supply of dry air, and one for exhaust of ambient air. After the unit is filled with dry air, the needles are removed and cement is inserted into the foam as required over the needle openings.
11. Next, 1/16"×1" wide foam mounted on the stripping tape is field supplied to correct for windows which are out of square.
12. The completed barrier can be sized for the specific window opening which is then installed by forcing and compressing the closed cell foam 25 into position and in the window opening, and the barrier is held pin position due to tight frictional fit.
13. The barrier 10 is removed by inserting a thin tool between the joint of the window and the foam to overcome the frictional force.
14. The foam 25 will recover to approximate original dimension of ¾" upon removal from the opening and ready for re-installation.
15. In the event a set in the foam 25 occurs after considerable time, an additional foam strip may be applied.

The following is given as certain general comments relative to the barrier of the present invention:

1. Custom window sizes up to 4'—0" by 8'—0" can be constructed with the design, and the preferred mode is to manufacture the units for existing stock size window openings and to accomplish fit by the addition of foam tape as required or desired.
2. The plastic sheets 16 and 17 are bent to form the 90° angle stiffener along the lines 20 so that the bent portions 19 provide the required structural integrity of the barrier.
3. Expansion space is provided by the ¾" foam stripping 25.
4. The closed cell of different polymers exist and are readily available. However, the preferred polymer for the present invention is EPT Polyethylene/Butyl with a density of 2# to 5# per cubic foot. Other polymers available are Neoprene, Nitrile, Hydrin, Vinyl Nitrile, and the like.
5. Although any plastic may be used for the sheeting material, a very thin 4 oz. per square foot or approximately 1/32" thick sheeting is produced by Plaskalite in Columbus, Ohio. Due to cost and lightweight, the preferred embodiment envisions this material.
6. The sheeting material 16 and 17 may be clear, tinted, or opaque.
7. Condensation is not expected since the barrier 10 is installed on the inside where the temperature of the barrier will be above the dew point.
8. If the cracks in the existing windows are substantial, the barrier may be subject to wind pressure. The pressure on the barrier 10 will be relieved by permitting the top of the barrier to move inward due to wind pressure, a distance equal to the area of the cracks in the existing window by installing two support points or clips 30 inward of the barrier's vertical plane. In FIG. 3, the numeral 32 indicates the space provided for this purpose. The bottom of the window is supported in its original position at two points as indicated by the numeral 31.

9. The barrier can be installed in an existing opening with only a 1" jamb-head and sill width.
10. All materials are readily available from suppliers.
11. The co-efficient of transmission of the barrier is 0.37.
12. The co-efficient of transmission of ⅛" glass is 1.13.
13. Materials with a life expectancy of up to ten years are proposed to be incorporated into the present invention.
14. The art of bending the plastic sheeting 16 and 17 for structural integrity and the manufacturing process of the barrier can be carried out in a unique and advantageous fashion.

With regard to the members 30, these may be 1"×1" long clip angles or recessed spring plungers. A suitable bonding adhesive can be used for securing the foam 25 to the outer edge portions of the panels 21. Glazing material can be provided for the barrier. The members 25 are in the form of closed cell foam continuous around the entire perimenter. There is provided a sealed air space within the panel or barrier 10 as indicated by the numeral 34. The sealed air space 34 is illustrated in FIG. 3. The members 31 may be 1"×1"×1" long clip angles or spring plungers recessed. As shown in FIG. 2D, exhaust ports and inflation ports can be provided for the fittings 26 and 27, and after the fittings or needles are removed, these ports can be suitably sealed with cement or the like.

It will be seen that with the present invention, there is provided a dead air space, including space 33 between the existing window 11 and the storm window or thermal barrier 10. In addition, there is provided the dead air space 34 within the barrier 10, and this construction provided for maximum insulating properties.

The thermal barrier of the present invention possesses flexibility because the foam 25 can adjust to irregular surfaces quickly and easily, the device is inexpensive to produce and easy to install. The present invention is designed for installation on the inside of an existing window opening and thus reduces the overall heat transmission, air infiltration by leakage and solar heat gain. The present invention can be used as a retrofit or otherwise construction, and the thermal barrier provides important energy consumption savings as previously described.

It is to be understood that the barrier can also be used in an opening without an existing window.

While several embodiments of the present invention have been illustrated herein in particular detail, it will be understood that variations and modifications may be effected without departing from the spirit and scope of the novel concepts of this invention.

We claim:

1. A thermal barrier comprising a dual plastic pane sealed air unit which does not require a separate frame, said barrier adapted to be installed on the inside of an existing window opening and mounting within the existing jamb, head, and sill on the inside of the existing window which remains in place, said barrier comprising a pair of rectangular sheets each having cut away corners, edge portions of said sheets being folded at 90 degrees relative to the main portion of the sheets to provide a pair of pan like members, said pan like members being interfitted together to form a hollow box-like member, foam pieces mounted around the periphery of the box-like member, means for withdrawing ambient air from the interior of the box-like member, and means for introducing dry air, inert gas, and the like into the interior of the member, retaining means mounted adjacent to said thermal barrier.

2. The structure as defined in claim 1 wherein the retaining means comprises lower angle clips arranged adjacent to the thermal barrier, and upper angle clips spaced slightly away from the thermal barrier.

3. The structure as defined in claim 2 wherein the thermal barrier is spaced away from said existing window.

4. A method of making a thermal barrier comprising the steps of providing a pair of rectangular sheets of plastic material, cutting away corner portions of each of the sheets, next bending and folding edge portions of the sheets at a 90 degree angle with respect to the main body portions of the sheets to provide a pair of pan members next, interfitting the pan members together to form a hollow, closed panel, and then withdrawing ambient air from the interior of the panel and introducing dry air, inert gas, and the like into the hollow interior of the panel to provide a thermal barrier for use with the existing windows.

5. In a thermal barrier for use with windows including a head jamb and sill and existing wall and opening, said thermal barrier comprising a dual plastic sealed air unit that does not require a separate frame, said barrier being designed for installation on the inside of an existing window opening and which mounts within the existing jamb, head, and sill of the inside of the existing window which remains in place, said barrier consisting of a pair of rectangular sheets of plastic, each of said sheets having all four corners cut to provide notches, the edge portions of said sheets being bent and folded at 90 degrees to form a pair of flat pan members, one of said pan members being slightly larger than the other pan member, and wherein the pan members are interfitted with each other, cement in the corners of the pans, compressible foam pieces secured to the outer periphery of the panel formed by the interfitting pan members, means for removing ambient air from the interior of the barrier, means for introducing dry air, inert gas, and the like into the interior of the barrier, and clip means adjacent to said barrier.

6. The structure as defined in claim 5 wherein said clip means comprise lower clips at the corners of the barrier which are contiguous to the barrier, and upper clips which are spaced slightly away from the barrier, and wherein the upper clips are disposed inwardly from the upper corners of said barrier.

7. The structure as defined in claim 6 wherein there is provided a space between the barrier and the existing windows.

8. In a barrier for use in an opening without an existing window, said barrier comprising a pair of rectangular sheets of plastic, each of said sheets having all four corners cut to provide notches, the edge portions of said sheets being bent and folded at 90 degrees to form a pair of flat pan members, one of said pan members being slightly larger than the other pan member, and wherein the pan members are interfitted with each other, cement in the corners of the pans, compressible foam pieces secured to the outer periphery of the panel formed by the interfitting pan members, means for removing ambient air from the interior of the barrier, means for introducing dry air, inert gas, and the like into the interior of the barrier, and clip means adjacent to said barrier.

9. The structure as defined in claim 8 wherein said clip means embody lower clips at the corners of the barrier which are contiguous to the barrier, and upper clips which are spaced slightly away from said barrier, and wherein the upper clips are disposed inwardly from the upper corners of the barrier.

10. A thermal barrier for use with windows embodying a head jamb and sill, and existing wall and window opening, said thermal barrier adapted to save up to 70% of the energy loss and gain through the window opening, said thermal barrier being installed on the inside of existing windows, said thermal barrier being easily installed, removed and cleaned, and being capable of structurally spanning large areas, said barrier reducing condensation on an existing window and the barrier allowing for expansion and contraction, said thermal barrier including a dual plastic sealed air unit that does not require a separate frame, said barrier being constructed for installation on the inside of an existing window opening and which mounts within the existing jamb head and sill of the inside of the existing window which remains in place, the barrier including a pair of rectangular sheets of transparent plastic, each of said sheets having all four corners cut to provide notches, the edge portions of said sheets being bent and folded at 90 degrees to form a pair of flat pan members, one of said pan members being slightly larger than the other pan member and wherein the pan members are interfitted and cemented with each other, cement in the corners of the pans, clip means adjacent to said barrier, said clip means comprising lower clips at the corners of the barrier which are contiguous to the barrier, and upper clips which are spaced slightly away from the barrier, and upper clips being disposed inwardly from the upper corners of said barrier, there being a space between the barrier and the existing window, and said thermal barrier reducing sound transmission through the window opening.

* * * * *